US005184945A

United States Patent [19]

Chi-Wei

[11] Patent Number: 5,184,945

[45] Date of Patent: Feb. 9, 1993

[54] BUSHING STRUCTURE FOR USING IN MAGNETICALLY DRIVING CENTRIFUGAL PUMPS

[75] Inventor: Shi Chi-Wei, Tao Yuan Hsien, Taiwan

[73] Assignee: Assoma, Inc., Taiwan

[21] Appl. No.: 813,008

[22] Filed: Dec. 24, 1991

[51] Int. Cl.[5] ..... F04B 39/06

[52] U.S. Cl. ..... 417/420; 417/423.12; 417/366; 415/111; 384/321

[58] Field of Search ..... 417/420, 423.12, 366; 415/111, 112; 384/321, 317, 398

[56] References Cited

U.S. PATENT DOCUMENTS

| | | | |
|---|---|---|---|
| 3,933,416 | 1/1976 | Donelian | 415/111 |
| 4,013,384 | 3/1977 | Oikawa | 417/420 |
| 4,047,847 | 9/1977 | Oikawa | 417/420 |
| 4,115,038 | 9/1978 | Litzenberg | 417/423.12 |
| 4,577,797 | 3/1986 | Martin | 384/398 |
| 4,812,108 | 3/1989 | Kotera | 415/111 |
| 4,850,818 | 7/1989 | Kotera | 417/366 |

FOREIGN PATENT DOCUMENTS

| | | | |
|---|---|---|---|
| 207641 | 12/1967 | U.S.S.R. | 384/321 |

*Primary Examiner*—John J. Vrablik

*Assistant Examiner*—Peter Korytnyk

*Attorney, Agent, or Firm*—Bacon & Thomas

[57] ABSTRACT

A centrifugal pump comprising a housing having an open end covered by a rear cover and a front cover, overlapping each other. A fixed central shaft is disposed along a central rotation axis of the centrifugal pump with a driven magnet member disposed therearound to rotate with respect thereto. The driven member is enclosed by an enclosure which is an extension of an impeller disposed within an interior space defined between the rear and front covers. The driven member is driven by a driving magnet member in fluid isolation from the driven member. The driving member is mechanically connected to a motor and actuated thereby. A bushing with internal and external cooling grooves formed thereon is provided between the fixed shaft and the driven member enclosure and a fluid passage is defined along the enclosure to conduct the pumped fluid to the cooling grooves of the bushing and to force the fluid flowing therethrough and then circulating back to the impeller so as to dissipate heat generated between the fixed shaft and the bushing. A resilient V-shaped cross section ring is provided on both ends of the bushing to absorb thrust generated by the bushing during the operation of the centrifugal pump.

10 Claims, 6 Drawing Sheets

BUSHING STRUCTURE FOR USING IN MAGNETICALLY DRIVING CENTRIFUGAL PUMPS

FIELD OF THE INVENTION

The present invention relates generally to a centrifugal pump and in particular to a bushing used in the centrifugal pump as the bearing support for the rotating member thereof.

BACKGROUND OF THE INVENTION

Conventional centrifugal pumps usually comprise, as shown in FIG. 7, a housing 300 inside which driving magnetic means 230 is circumferentially disposed around a rotation axis (not explicitly designated in the drawings). The housing 300 is secured to a motor 250 (only a portion thereof is shown in FIG. 7). The driving magnetic means 230 is secured to a spindle of the motor 250 and supported thereby so as to be rotatable about the rotation axis with the spindle of the motor 250. The housing 300 has an opening to receive therein a rear cover 220 to seal the housing 300.

The rear cover 220 has a central recess which is generally concentric with the driving magnetic means 230 and receiving therein driven magnetic means 224 which is circumferentially disposed around the rotation axis and is concentric with the driving magnetic means 230 so that when the driving means 230 is rotated by the motor, the driven means 224 follows the driving means 230 due to the magnetic force therebetween. To bearingly support the rotation of the driven means 224, a fixed central shaft 221 with a bushing 222 encompassing therearound is concentrically disposed inside the driven means 224. Retainers 226 are also disposed on the fixed central shaft 221 to keep the bushing 222 in position.

A front cover 210 overlaps the rear cover 220 and secured thereto in such a way that an interior is formed therebetween to receive therein an impeller 225. The impeller 225 has an extension toward the central recess of the rear cover 220 to cover the driven means 224, forming a plastic enclosure 223 thereof, so that when the driven means 224 rotates about the fixed central shaft 221, the impeller 225 follows the rotation thereof. The front cover 210 also forms a spiral configuration for discharging the pumped fluid with a discharging port 212 on a lateral location thereof. The front cover 210 also has a suction eye 211 on a central and front portion thereof to draw in fluid to be pumped.

Friction between the bushing 222 and the fixed shaft 221 results in heat generated therebetween during rotation. A fluid passage 240 is formed along the outside surface of the plastic enclosure 223 with a first end thereof communicating the fluid discharging port 212 and a second end thereof communicating a plurality of spaced cooling grooves 255 which are helically or circumferentially formed on the inside surface of the bushing 222, i.e. the surface in contact with the fixed central shaft 221 so as to conduct the pumped fluid therethrough along the arrows shown in FIG. 7 to the cooling grooves 255. A returning passage 260 in communication with the cooling grooves 255 conducts the fluid back to the impeller 225.

With the circulation of fluid within the fluid passages 240 and 260 and the cooling grooves 250, the heat generated between the bushing 222 and the fixed central shaft 221 is brought away and thus the bushing is prevented from being overheated.

However, when the operation of the centrifugal pump is abnormal, such as unloaded operations caused by, for example, control device malfunction, inadequate operation, block-up of ducts, insufficient fluid level, the operation usually results in a significant increase of temperature in both the bushing 222 and the fixed shaft 221. Further, the high temperature deforms the plastic enclosure 223 of the driven means 224 so as to cause wear and abrasion of the plastic enclosure 223 and thus damage to the pump.

To overcome the deformation of the enclosure 223 resulted from a high temperature, pieces of material (not shown) which are able to bear high temperatures are attached to the enclosure 223. This, however, is not very effective, because a long period of unloaded operation of a centrifugal pump usually results in a temperature over 220 degrees Celsius and using heat-resistance materials is not sufficient to protect the enclosure. Besides, adding the heat-resistance material also increases the difficulty and cost of manufacture.

It is therefore desirable to provide a centrifugal pump of which the unloaded operation will not cause a significant temperature increase inside the pump for a very long period, as compared with the conventional centrifugal pump structures.

OBJECTS OF THE INVENTION

It is therefore the object of the invention to provide a centrifugal pump which is capable to operate without any load for a long period and the temperature increase resulted therefrom is maintained in an acceptable level so as to keep the pump operable after such a long period of unloaded operation.

It is another object of the present invention to provide a centrifugal pump of which the shaft bushing is capable of dissipating a large amount of heat to thus keep the temperature within an acceptable level.

It is a further object of the present invention to provide a centrifugal pump of which the retaining device for the bushing is a flexible ring for absorbing the thrust generated in the operation of the pump.

To achieve the object, there is provided a centrifugal pump comprising a housing having an open end covered by a rear cover and a front cover, overlapping each other. A fixed central shaft is disposed along a central rotation axis of the centrifugal pump with driven magnet means disposed therearound to rotate with respect thereto. The driven means is enclosed by an enclosure which is an extension of an impeller means disposed within an interior space defined between the rear and front covers. The driven means is driven by driving magnet means in fluid isolation from the driven means. The driving means is mechanically connected to a motor and actuated thereby. A bushing with internal and external cooling grooves formed thereon is provided between the fixed shaft and the driven means enclosure and a fluid passage is defined along the enclosure to conduct the pumped fluid to the cooling grooves of the bushing and to force the fluid flowing therethrough and then circulating back to the impeller means so as to dissipate heat generated between the fixed shaft and the bushing. A resilient V-shaped ring is provided on both ends of the bushing to absorb thrust generated by the bushing during the operation of the centrifugal pump.

Other objects and advantages of the invention will be apparent from the following description of the preferred embodiment taken in connection with the accompanying drawings wherein:

DETAILED DESCRIPTION OF THE PREFERRED EMBODIMENT

Figure 1:
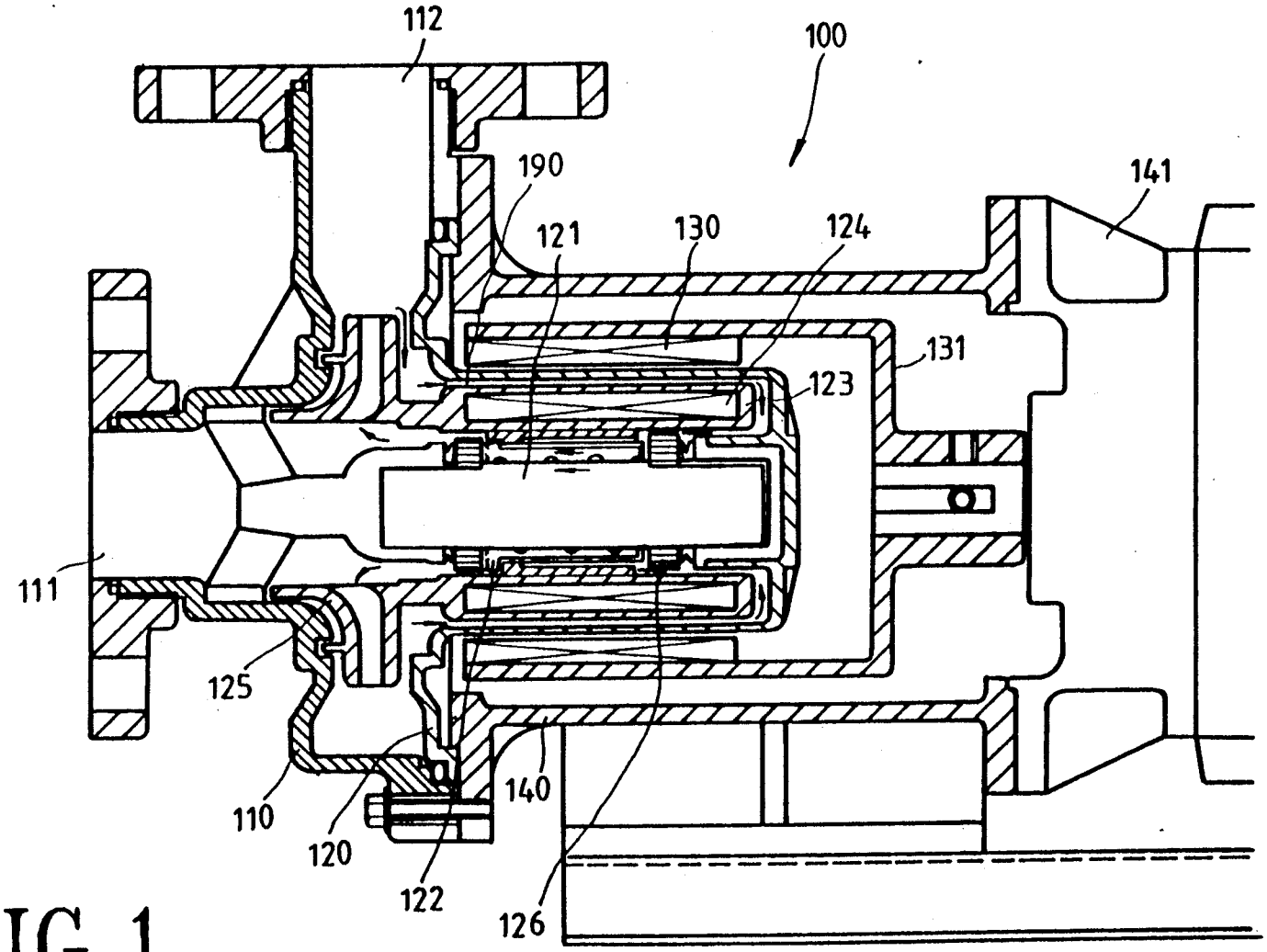
FIG. 1 is a cross-sectional view of a centrifugal pump with a bushing constructed in accordance with the present invention.

With reference to the drawings and in particular to FIG. 1, a centrifugal pump in accordance with the present invention, generally designated with the reference numeral 100, comprises a housing 140 inside which driving magnetic means 130 is circumferentially disposed around a rotation axis (not explicitly designated in the drawings) so as to define an interior therein. The housing 140 is secured to a motor 141 (only a portion thereof is shown in FIG. 1) with any known means, such as screws. The driving magnetic means 130 is mounted on a supporting member 131 which in turn is mechanically secured to a spindle of the motor 141 with any known means so that the driving magnet means is rotatable about the rotation axis with the spindle of the motor 141. The housing 140 has an open end to receive therein a rear cover 120 to seal the housing 140.

The rear cover 120 has a central recess which is generally concentric with the driving magnetic means 130 and extends into the interior of the driving magnet means 130 to receive therein driven magnetic means 124 which is circumferentially disposed around the rotation axis so as to define an interior therein which is opposite to and concentric with the driving magnet means 130 so that when the driving magnet means 130 is rotated by the motor 141, the driven magnet means 124 follows the driving magnet means 130 due to the magnetic force therebetween. To bearingly support the rotation of the driven magnet means 124, a fixed central shaft 121 with a bushing 122 composed therearound is concentrically disposed in the interior of the driven magnet means 124 and substantially along the rotation axis of the centrifugal pump 100. Retainers 126 are disposed around the fixed central shaft 121 to keep the bushing 122 in position.

A front cover 110 overlaps the rear cover 120 and secured thereto or to the housing 140 in such a way that an interior space is formed therebetween to receive therein an impeller 125. The impeller 125 has an extension toward the central recess of the rear cover 120 to cover the driven magnet means 124, forming an enclosure 123 thereof, so that when the driven means 124 rotates about the fixed shaft 121, the impeller 125 follows the rotation thereof. The front cover 110 also forms a spiral configuration for discharging the pumped fluid with a discharging port 112 on a lateral location thereof. The front cover 110 also has an suction eye 111 on a central front portion thereof to draw in fluid to be pumped.

Figure 7:
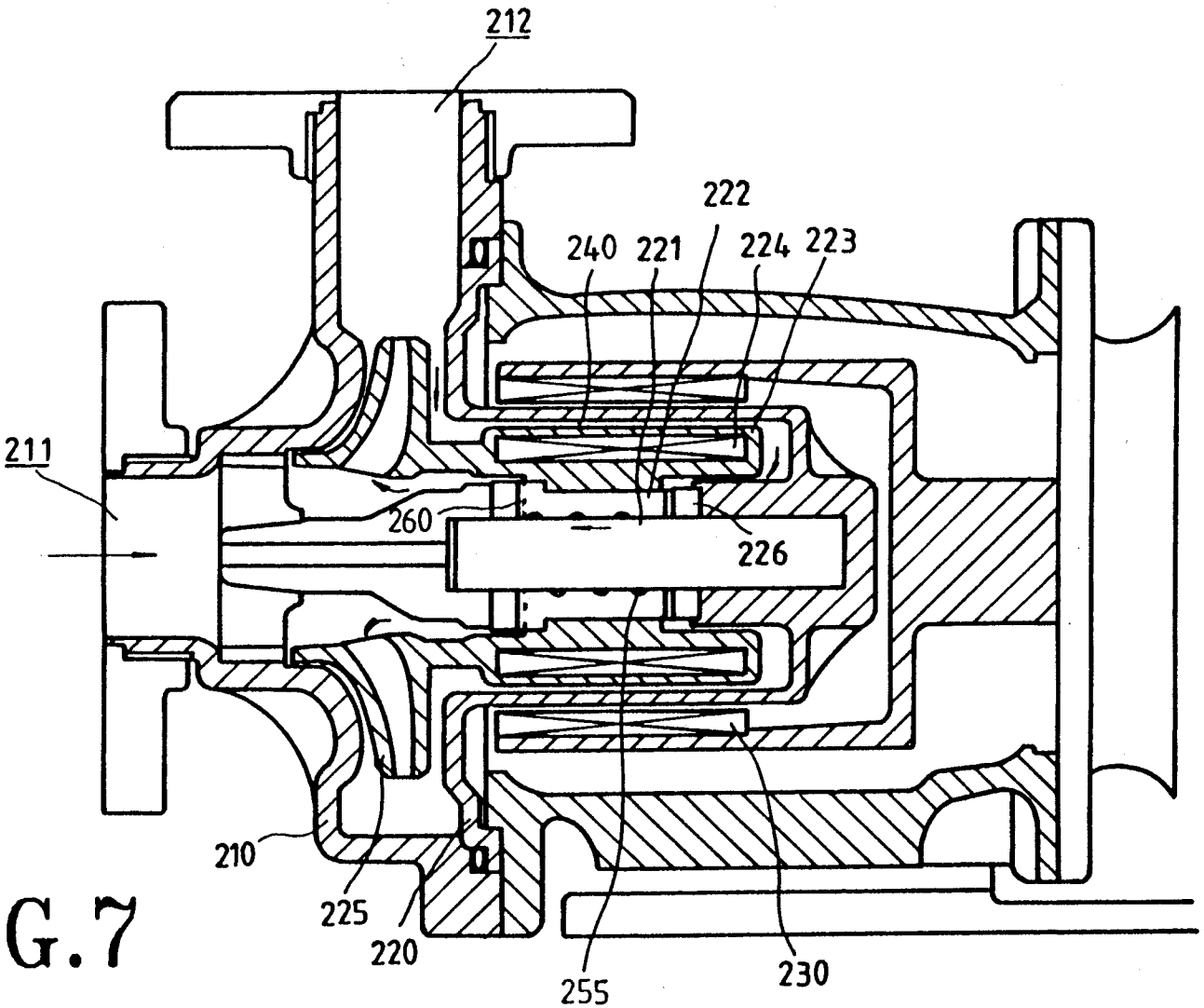
FIG. 7 is a cross-sectional view of a prior art centrifugal pump.

To this point, the centrifugal pump 100 in accordance with the present invention is similar to the prior art centrifugal pump shown in FIG. 7.

Figure 2:
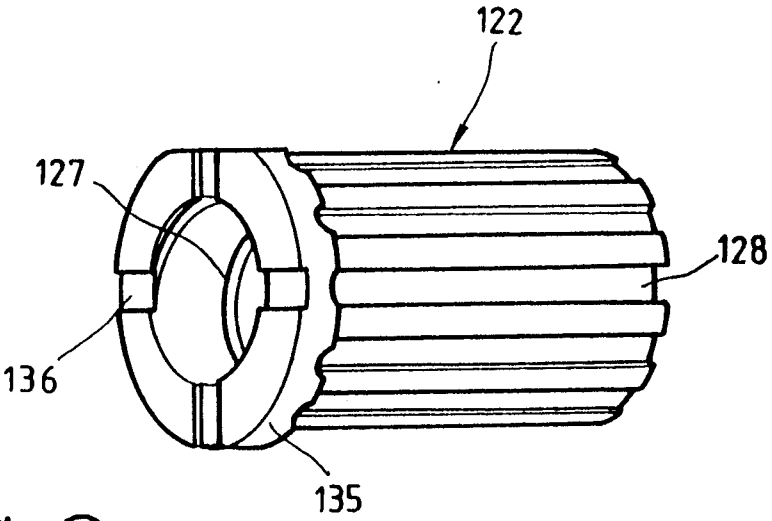
FIG. 2 is a perspective view of the bushing body constructed in accordance with the present.

Referring to FIG. 2, the bushing in accordance with the present invention is shown in detail. The bushing has a body 122 different from its counterpart used in a prior art centrifugal pump in that besides the internal helical cooling grooves 127 that formed on the inside surface of the bushing body 122, there are provided a plurality of external and spaced straight grooves 128 formed on the outside surface of the bushing body 122 in parallel with the rotation axis. The bushing body 122 has an expanded end 135 which is located close to the impeller 125 with a plurality of returning passages 136 formed thereon to be in fluid communication with the internal helical grooves 127 and the interior of the impeller 125 so as to conduct the fluid back to the impeller 125.

Figure 4:
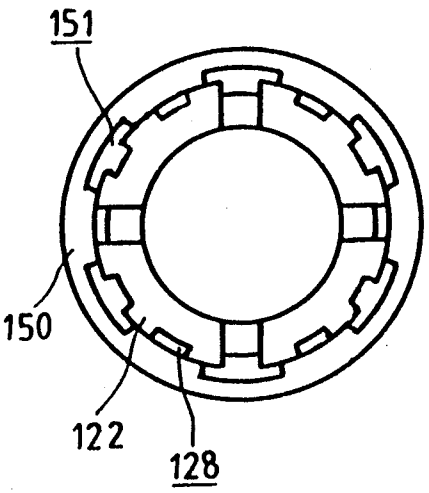
FIG. 4 is a side elevational view of the elements shown in FIG. 3.
Figure 3:
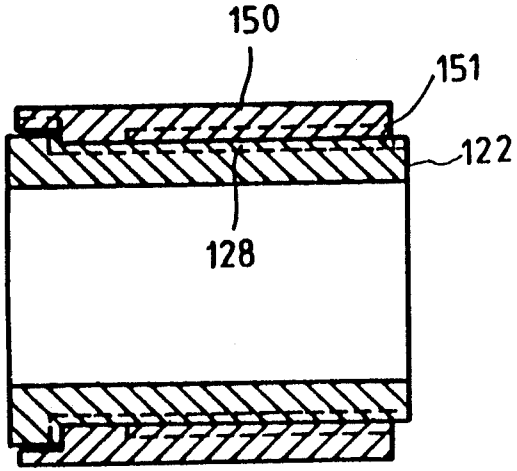
FIG. 3 is a cross-sectional view of the bushing body shown in FIG. 2, together with a jacket thereof.

Further referring to FIGS. 3 and 4, the bushing in accordance with the present invention further comprises a cylindrical jacket 150 disposed around the bushing body 122. The jacket 150 has a plurality of internal straight slots 151 running parallel with the rotation axis to cooperate with the external grooves 128 of the bushing body 122 to define fluid channels for conducting fluid therethrough. In the preferred embodiment as that shown in FIGS. 3 and 4, there are six slots 151 formed on the jacket 150 and twelve external grooves 128 formed on the bushing body 122. Therefore, each slot 151 of the jacket 150 has two grooves 128 of the bushing body 122 to match therewith. The width of the slots 151 of the jacket 150 is about twice that of the grooves 128 of the bushing body 122. The jacket 150 has a shoulder which abuts against the expanded end 135 of the bushing body 122 to keep the jacket 150 in position. With the external grooves 128 of the bushing body 122 and the internal slots 151 of the jacket 150, the volume of fluid flowing through around the bushing body 122 is significantly increased so as to be able to dissipate a great amount of heat, even though the fluid is air only.

Further referring to FIG. 1, a fluid passage 190 is formed along the outside surface of the enclosure 123 with a first end thereof communicating the fluid discharging port 112 and a second end thereof communicating both the internal helical cooling grooves 127 inside the bushing body 122 and the straight cooling grooves 128 outside the bushing body 122 to conduct fluid, along the direction of the arrows shown in FIG. 1, from the discharging port 112 to the cooling grooves 127 and 128. The fluid is then returned to the interior of the impeller 125 through the returning passage 136 or directly, as shown in FIG. 2.

Although it is not explicitly illustrated how the pumped fluid flows in the centrifugal pump 100, it is understood by those skilled in the art that the fluid to be pumped is drawn into the centrifugal pump 100 from the suction eye 111 of the front cover 110 and then pumped while passing through the impeller 125 to increase the head thereof due to the energy input of the rotation of the motor spindle. The pumped fluid is then collected and guided by the front cover 110 which may assume a volute configuration and then discharged from the discharging port 112 of the front cover 110.

It is understood that the present invention can be applied to other types of centrifugal pump or other types of pumps which utilize the pumped fluid to cool themselves. It is also possible to apply the present invention to mechanical devices of other types provided that a fluid is used to cool the devices.

It is apparent that to those skilled in the art, modifications and changes of the present invention can be done within the scope and spirit of the present invention and those modifications and changes are considered part of the invention defined in the appended Claims.

Figure 8:
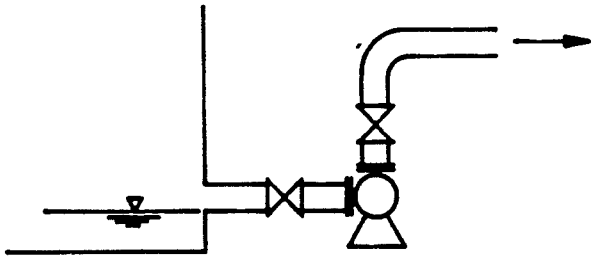
FIGS. 8–12 are schematic views showing different operation conditions used to test the centrifugal pump in accordance with the present invention.

The remarkable achievement in dissipating heat, that can be accomplished with the present invention, is shown in the following Tables. When a centrifugal pump is operated in a normal situation for a period and thereafter, the fluid to be pumped is almost empty and no fluid is possible to be further drawn into the centrifugal pump, the centrifugal pump is operated in an unloaded situation, as shown in FIG. 8. For a prior art centrifugal pump operated in such a situation, its temperature rises and reaches 100.2 degrees Celsius in 79 minutes. The inside diameter of the bushing thereof has been worn out 0.021 mm after 79 minutes of unloaded operation. Since a bushing has to be replaced after worning down 1 mm, the bushing of the prior art centrifugal pump thus should be replaced in 54.8 hours, if it is kept operating in such an unloaded condition. The experiment data of this situation is listed in Table 1. It should be noted that in the following Tables, the unit for time is minute and that for temperature is degree Celsius.

TABLE 1

| (Room Temperature 23 degrees Celsius) | |
|---|---|
| time | temperature |
| 0 | 25.0 |
| 1 | 27.0 |
| 2 | 32.0 |
| 3 | 38.0 |
| 4 | 44.0 |
| 5 | 49.5 |
| 6 | 55.0 |
| 7 | 59.8 |
| 8 | 64.0 |
| 9 | 67.5 |
| 10 | 70.6 |
| 11 | 72.7 |
| 12 | 74.5 |
| 13 | 76.5 |
| 14 | 77.5 |
| 15 | 78.5 |
| 16 | 79.7 |
| 17 | 80.7 |
| 18 | 81.8 |
| 19 | 82.7 |
| 20 | 83.7 |
| 21 | 84.5 |
| 22 | 85.5 |
| 23 | 86.5 |
| 24 | 86.8 |
| 25 | 87.5 |
| 26 | 88.5 |
| 27 | 88.8 |
| 28 | 88.8 |
| 29 | 88.9 |
| 30 | 90.5 |
| 31 | 91.3 |
| 32 | 91.7 |
| 33 | 92.4 |
| 34 | 92.5 |
| 35 | 92.8 |
| 36 | 93.3 |

TABLE 1-continued

| (Room Temperature 23 degrees Celsius) | |
|---|---|
| time | temperature |
| 37 | 93.6 |
| 38 | 94.2 |
| 39 | 94.4 |
| 40 | 94.7 |
| 41 | 94.9 |
| 42 | 95.5 |
| 43 | 95.5 |
| 44 | 95.7 |
| 45 | 95.7 |
| 47 | 96.0 |
| 54 | 97.2 |
| 55 | 97.5 |
| 58 | 97.5 |
| 59 | 97.7 |
| 60 | 97.7 |
| 63 | 97.7 |
| 75 | 99.5 |
| 76 | 99.8 |
| 77 | 99.8 |
| 78 | 100.0 |
| 79 | 100.2 |

Figure 9:
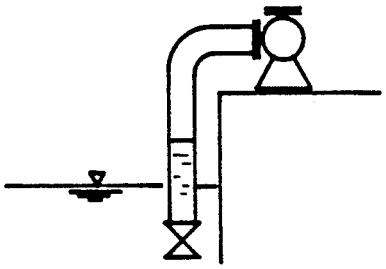
Figure 10:
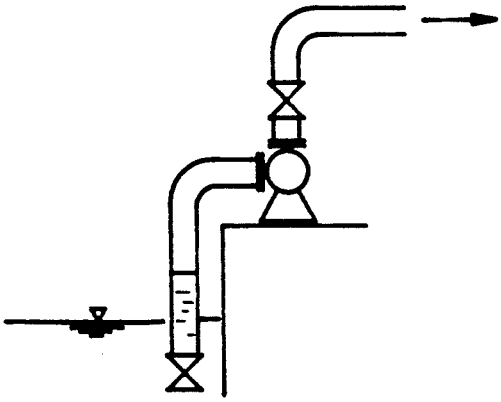

When a centrifugal pump is placed in an attitude higher than fluid level to be pumped and when there is air present in the in-duct, the pump will not be able to draw in fluid and thus will operate in an unloaded situation, as shown in FIG. 9 or FIG. 10. Table 2 shows such a situation for a prior art centrifugal pump. It is noted from the Table that although the temperature rise is slow, as compared to Table 1, the temperature reaches 92.0 degrees Celsius in two hours and the wearing of the bushing is 0.025 mm. It is estimated that the bushing has to be replaced in 80 hours.

TABLE 2

| (Room Temperature 22 degrees Celsius) | |
|---|---|
| time | temperature |
| 0 | 22.3 |
| 1 | 24.0 |
| 2 | 28.0 |
| 3 | 32.3 |
| 4 | 37.0 |
| 5 | 41.3 |
| 6 | 45.5 |
| 7 | 49.0 |
| 8 | 52.3 |
| 9 | 55.3 |
| 10 | 58.1 |
| 11 | 61.0 |
| 12 | 63.5 |
| 13 | 65.5 |
| 14 | 67.9 |
| 15 | 69.8 |
| 16 | 71.5 |
| 17 | 73.3 |
| 18 | 74.5 |
| 19 | 76.0 |
| 20 | 77.3 |
| 21 | 78.1 |
| 22 | 79.1 |
| 23 | 80.0 |
| 24 | 80.7 |
| 25 | 81.3 |
| 26 | 83.0 |
| 27 | 83.7 |
| 28 | 84.3 |
| 35 | 86.5 |
| 43 | 88.0 |
| 50 | 90.0 |
| 95 | 91.0 |
| 120 | 92.0 |

Table 3 shows the experiment data obtained with the centrifugal pump of the present invention is operated in the same situation of Table 1, namely what shown in FIG. 8. It is noted that the temperature rises initially and the highest value is 71 degrees Celsius reached in 48 minutes and reduced thereafter to slightly more than 50 degrees Celsius. Finally a balance is reached. The temperature is 52.5 degrees Celsius after an 8 hour unloaded operation and the bushing is worn out only 0.018 mm. It is therefore concluded that the bushing can be used for a period of 1,333 hours in such an unloaded situation.

TABLE 3

| (Room Temperature 23 degrees Celsius) | |
|---|---|
| time | temperature |
| 0 | 23.5 |
| 2 | 30.0 |
| 4 | 35.0 |
| 5 | 36.0 |
| 6 | 38.0 |
| 7 | 40.5 |
| 8 | 42.5 |
| 9 | 44.8 |
| 10 | 46.5 |
| 11 | 48.3 |
| 12 | 50.2 |
| 13 | 51.9 |
| 14 | 53.5 |
| 15 | 55.4 |
| 16 | 57.0 |
| 17 | 58.6 |
| 18 | 60.0 |
| 19 | 61.6 |
| 20 | 62.5 |
| 21 | 63.6 |
| 22 | 64.8 |
| 23 | 65.5 |
| 24 | 66.4 |
| 25 | 67.3 |
| 26 | 67.5 |
| 27 | 68.2 |
| 28 | 68.5 |
| 29 | 68.7 |
| 30 | 69.0 |
| 31 | 69.3 |
| 32 | 69.6 |
| 33 | 69.8 |
| 34 | 70.0 |
| 35 | 70.2 |
| 36 | 70.5 |
| 37 | 70.5 |
| 38 | 70.7 |
| 39 | 70.7 |
| 40 | 70.7 |
| 41 | 70.8 |
| 42 | 70.8 |
| 43 | 70.8 |
| 44 | 70.8 |
| 45 | 70.9 |
| 46 | 70.9 |
| 47 | 70.9 |
| 48 | 71.0 |
| 60 | 70.5 |
| 65 | 70.3 |
| 80 | 68.7 |
| 97 | 66.0 |
| 133 | 63.4 |
| 145 | 62.0 |
| 150 | 61.5 |
| 168 | 60.2 |
| 244 | 56.5 |
| 277 | 55.5 |
| 337 | 54.0 |
| 387 | 53.0 |
| 467 | 52.5 |

The result of Table 3 illustrates the significant improvement of the present invention over the prior art and the advantages of the present invention are further signified in the following experiment in which the temperature rise of the centrifugal pump of the present invention operated in an unloaded situation is limited within an acceptable level without any fluid exchange with the outside environment.

Figure 11:
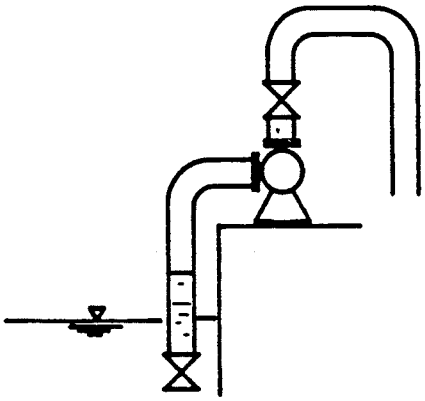
Figure 12:
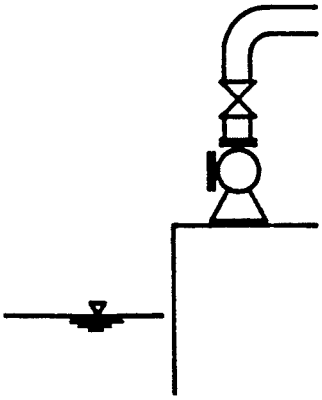

Table 4 is the result of an experiment with the centrifugal pump of the present invention. In the first phase of the experiment, the operation situation is as shown in FIG. 9 and the pump is not able to draw in fluid due to the air present in the in-duct and thus the temperature rises. When the temperature reaches a certain level, for example 42.3 degree Celsius in this embodiment, the fluid remaining inside the centrifugal pump evaporates and the temperature drops down slightly (to 41.5 degrees in this embodiment). If, at this moment (the 123th minute of the experiment), an out-duct is attached to the exit of the pump, as shown in FIG. 10, the temperature rises again to 45.3 degrees Celsius and then back to 44.5 degrees Celsius (due to the dissipation of heat). At the moment (the 148th minute of the experiment), the newly-added out-duct is bent to negatively affect the dissipation of heat, as shown in FIG. 11, it is found that the temperature continues dropping. This is because of the excellent dissipation of heat produced by the bushing constructed in accordance with the present invention. Thereafter, at the 328th minute after the commencement of the experiment, the inlet of the centrifugal pump is closed so that no fluid, both liquid and gas, is possible to be drawn into the pump and the outlet valve is open. The temperature is still dropping. It is found that closing the outlet valve does not affect the dissipation of heat in the centrifugal pump and the result will be similar to that shown in Table 4. It is found that the bushing is worn down only 0.013 mm after operated 24 hours in such an unloaded situation and thus the bushing need not to be replaced in at least 1,846 hours. Since the temperature is still dropping at the end of this experiment, it is therefore believed that the bushing need not be replaced in a longer period than the above estimated period.

TABLE 4

| (Room Temperature 22 degrees Celsius) | |
|---|---|
| time | temperature |
| 0 | 23.0 |
| 1 | 24.0 |
| 2 | 25.8 |
| 3 | 27.0 |
| 4 | 28.0 |
| 5 | 29.5 |
| 6 | 31.0 |
| 7 | 32.0 |
| 8 | 33.0 |
| 9 | 33.8 |
| 10 | 34.5 |
| 11 | 35.1 |
| 12 | 35.8 |
| 13 | 36.3 |
| 14 | 36.7 |
| 15 | 37.0 |
| 16 | 37.5 |
| 17 | 37.8 |
| 18 | 38.0 |
| 19 | 38.2 |
| 20 | 38.6 |
| 21 | 38.8 |
| 22 | 38.9 |
| 23 | 39.0 |
| 24 | 39.0 |
| 25 | 39.1 |
| 26 | 39.3 |
| 27 | 39.3 |
| 28 | 39.3 |
| 29 | 39.5 |
| 30 | 39.5 |
| 52 | 40.3 |
| 75 | 42.3 |

TABLE 4-continued

| (Room Temperature 22 degrees Celsius) | |
|---|---|
| time | temperature |
| 120 | 41.5 |
| 123 | 42.0 |
| 125 | 43.2 |
| 126 | 44.0 |
| 127 | 44.4 |
| 128 | 44.6 |
| 129 | 44.8 |
| 132 | 45.3 |
| 148 | 44.5 |
| 215 | 44.5 |
| 228 | 44.0 |
| 325 | 43.7 |
| 328 | 43.7 |
| 345 | 41.7 |
| 367 | 40.3 |
| 462 | 39.4 |
| 463 | 39.2 |

Figure 5:
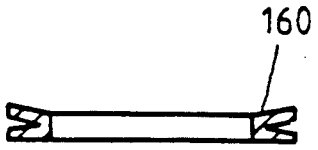
FIG. 5 is a cross-sectional view of a flexible V-shaped cross section retaining ring in accordance with the present invention.
Figure 6:
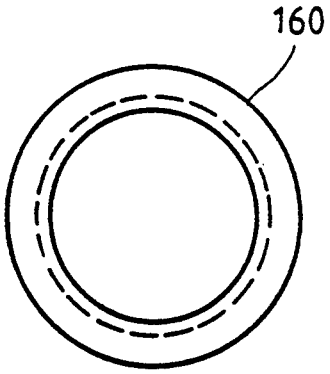
FIG. 6 is a top view of the flexible V-shaped cross section retaining ring shown in FIG. 5.

Referring to FIGS. 1, 5 and 6, the present invention further provides a plurality of V-shaped cross section rings 160 which are made of a resilient and preferably temperature-resistance material. The bushing body 122 is maintained in position by the retainers 126 and the resilient V-shaped cross section rings 160 are disposed around the fixed central shaft 121 and abutting against the retainers 126 to absorb thrust acting on the retainers 126 during the operation of the centrifugal pump 100.

It is apparent that although the invention has been described in connection with the preferred embodiment, it is contemplated that those skilled in the art may make changes to certain features of the preferred embodiment without altering the overall basic function and concept of the invention and without departing from the spirit and scope of the invention as defined in the appended claims.

What is claimed is:

1. A bushing for use in a centrifugal pump wherein said centrifugal pump comprises a housing with one open end closed by a rear cover and a front cover, overlapping each other, with an interior defined between the rear and the front covers, said front cover defining an inlet eye for drawing in fluid to be pumped and an outlet for discharging pumped fluid, said rear cover further defining a recess extending into said housing to receive therein a fixed central shaft disposed along a central rotation axis of said centrifugal pump and a first magnet means disposed concentrically around said fixed shaft and rotatable with respect thereto, said centrifugal pump further comprising a second driving means disposed around said recess and concentric with and opposite to said first magnet means so as to have the first magnet means rotated therewith, said first magnet means being enclosed by an enclosure formed with an extension of an impeller means disposed within said interior defined by the rear and front covers, said bushing which is concentrically disposed between said fixed shaft and said first magnet means and maintained in position by retainers comprising a hollow cylindrical bushing body having an inside surface with internal helical cooling grooves formed thereon and an outside surface with a number of external straight cooling grooves generally parallel with the central axis of said centrifugal pump formed thereon, said bushing further comprising a cylindrical jacket concentrically disposed between the bushing body and the first magnet means, said jacket comprising a number of internal slots which are straight and generally parallel with the central axis of said centrifugal pump to cooperate with the external grooves of said bushing to define channels for fluid to flow therethrough, said bushing body further defining an expanded end close to the impeller means to retain said jacket in position, a conducting passage being formed between the outlet of the front cover and first ends of both the internal cooling grooves of the bushing body and said channels defined by the external grooves of the bushing body and the internal slots of the jacket to conduct part of the pumped fluid to both the internal cooling passage of the bushing body and the channels defined by the external cooling grooves of the bushing body and the internal slots of the jacket to cool the bushing and a returning passage being formed between said impeller means and second ends of both the internal cooling grooves of the bushing body and the channel defined by the external cooling grooves and the internal slots of the jacket to circulate the pumped fluid used to cool said bushing back to said impeller means.

2. A bushing as claimed in claim 1 wherein the number of said internal cooling grooves of the bushing body is different from that of the external slots of the jacket.

3. A bushing as claimed in claim 2 wherein the number of the external grooves of the bushing body is twice of that of the internal slots of the jacket.

4. A bushing as claimed in claim 1 wherein said internal slots of the jacket have a width different from that of the external grooves of the bushing body.

5. A bushing as claimed in claim 4 wherein said internal slots of the jacket have a width twice of that of said external grooves of the bushing body.

6. A bushing as claimed in claim 1 wherein the number of the external grooves of the bushing body is twice of that of the internal slots of the jacket and said internal slots of the jacket have a width twice of that of said external grooves of the bushing body.

7. A bushing as claimed in claim 6 wherein the number of the external groves of the bushing body is twelve and that of the internal slots of the jacket is six.

8. A centrifugal pump comprising:

a housing with an open end defining a central rotation axis thereof;

a rear cover secured on the open end of said housing to close said open end, said rear cover having a recess extending into said hosing;

a front cover secured on said rear cover to define an interior therebetween, said front cover further defining an inlet eye for drawing in fluid to be pumped and an outlet for discharging pumped fluid;

a fixed central shaft disposed inside said recess of the rear cover along said central axis;

driven magnet means disposed inside said recess and concentrically around said fixed shaft and rotatable with respect thereto, said driven magnet means having an enclosure covering thereon;

driving magnet means disposed around said recess and concentric with and opposite to said driven magnet means so as to have the driven magnet means rotated therewith with magnetic force therebetween;

an impeller means which is disposed in the interior defined by the rear and front covers and has an extension extending toward said driven magnet means to form said enclosure of the driven magnet means;

a bushing which is concentrically disposed between said fixed shaft and said driven magnet means and maintained in position by retainers comprising a hollow cylindrical bushing body having an inside surface with internal helical cooling grooves formed thereon and an outside surface with a number of external straight cooling grooves generally parallel with the central axis thereof formed thereon, said bushing further comprising a cylindrical jacket concentrically disposed between the bushing body and the driven magnet means, said jacket comprising a number of internal slots which are straight and generally parallel with the central axis of said centrifugal pump to cooperate with the external grooves of the bushing to define channels for fluid to flow therethrough, said bushing body further defining an expanded end close to the impeller means to retain the jacket in position, a conducting passage being formed between the outlet of the front cover and first ends of both the internal cooling grooves of the bushing body and the channels defined by the external grooves of the bushing body and the internal slots of the jacket to conduct part of the pumped fluid to both the internal cooling passage of the bushing body and the channels defined by the external cooling grooves of the bushing body and the internal slots of the jacket to cool the bushing and a returning passage being formed between the impeller means and second ends of both the internal cooling grooves of the bushing body and the channels defined by the external cooling grooves and the internal slots of the jacket to circulate the pumped fluid used to cool the bushing back to the impeller means.

9. A centrifugal pump as claimed in claim 8 further comprising a plurality of resilient V-shaped cross section rings disposed around the fixed shaft and abutting against the retainers so as to absorb thrust generated by the bushing.

10. A centrifugal pump as claimed in claim 8 wherein the number of the external grooves of the bushing body is different from that of the internal slots of the jacket and said internal slots of the jacket has a width different from that of said external grooves of the bushing body.

* * * * *